US011253049B2

(12) United States Patent
Barklow et al.

(10) Patent No.: US 11,253,049 B2
(45) Date of Patent: Feb. 22, 2022

(54) CARRYING DEVICES

(71) Applicant: W. L. Gore & Associates, Inc., Newark, DE (US)

(72) Inventors: John Barklow, Newark, DE (US); Sky Sterry, Newark, DE (US); Trisha Wookey, Newark, DE (US); Zachary D. West, Newark, DE (US); Eric Gilmore, Newark, DE (US)

(73) Assignee: W. L. Gore & Associates, Inc., Newark, DE (US)

( * ) Notice: Subject to any disclaimer, the term of this patent is extended or adjusted under 35 U.S.C. 154(b) by 3 days.

(21) Appl. No.: 16/758,711

(22) PCT Filed: Nov. 6, 2018

(86) PCT No.: PCT/US2018/059390

§ 371 (c)(1),
(2) Date: Apr. 23, 2020

(87) PCT Pub. No.: WO2019/090307

PCT Pub. Date: May 9, 2019

(65) Prior Publication Data

US 2020/0305581 A1 Oct. 1, 2020

Related U.S. Application Data

(60) Provisional application No. 62/582,168, filed on Nov. 6, 2017.

(51) Int. Cl.
*A45F 3/14* (2006.01)
*A45F 3/08* (2006.01)
(Continued)

(52) U.S. Cl.
CPC ..... *A45F 3/14* (2013.01); *A41D 13/0007* (2013.01); *A45F 3/08* (2013.01); *A45F 5/021* (2013.01);
(Continued)

(58) Field of Classification Search
CPC .... A45F 3/08; A45F 3/10; A45F 5/021; A45F 2003/045; A45F 2003/142;
(Continued)

(56) References Cited

U.S. PATENT DOCUMENTS 204,066 A * 5/1878 Merriam ..... A45F 4/04 224/154
1,920,061 A * 7/1933 Carr ..... A41F 9/002 224/676
(Continued)

FOREIGN PATENT DOCUMENTS

FR 2 608 122 A1 6/1988

OTHER PUBLICATIONS

International Search Report and Written Opinion from International Appln. No. PCT/US2018/059390 dated Mar. 23, 2019.

*Primary Examiner* — Adam J Waggenspack
(74) *Attorney, Agent, or Firm* — Greenberg Traurig, LLP

(57) ABSTRACT

A carrying device includes a retractable support system for equipment carried in the hand. In some embodiments, the carrying device comprises a frame assembly for transporting larger loads and optimizing the weight distribution thereof. In some embodiments, the carrying device includes a support shelf. In some embodiments, the carrying device includes an expandable volume.

11 Claims, 10 Drawing Sheets

(51) Int. Cl.

| | |
|---|---|
| ***A41D 13/00*** | (2006.01) |
| ***A45F 5/02*** | (2006.01) |
| *A45F 3/04* | (2006.01) |
| *A45F 5/00* | (2006.01) |

(52) U.S. Cl.
CPC ... *A45F 2003/045* (2013.01); *A45F 2003/142* (2013.01); *A45F 2003/144* (2013.01); *A45F 2005/006* (2013.01)

(58) Field of Classification Search
CPC ..... A45F 2003/144; A45F 2005/006; Y10T 24/1397; A41F 9/005; A41D 2400/48; A41D 27/22; A41D 13/0007; A62B 1/16; A62B 1/06; A62B 1/20; A62B 35/0037
USPC ..... 224/103, 220, 255; 24/3.13
See application file for complete search history.

(56) References Cited

U.S. PATENT DOCUMENTS 5,042,664 A * 8/1991 Shyr ..... A45C 13/02 206/579
5,730,340 A * 3/1998 Bosic ..... A45F 3/00 224/250
6,152,338 A 11/2000 Smith
6,161,739 A * 12/2000 Bentzen ..... A45F 3/08 224/153
6,179,188 B1 * 1/2001 Gleason ..... A45F 3/047 224/262
7,878,380 B2 * 2/2011 Bass ..... A45F 5/102 224/600
7,967,109 B2 * 6/2011 Petzl ..... A62B 35/0037 182/3
8,348,114 B2 * 1/2013 Gleason, Jr. ..... A45F 3/04 224/633
8,757,455 B2 * 6/2014 Smalley ..... A41D 7/00 224/250
8,870,045 B1 * 10/2014 Aguirre ..... A45F 3/04 224/651
9,027,812 B2 * 5/2015 Lester ..... A45F 3/08 224/628
9,173,462 B2 * 11/2015 Thompson ..... A45C 7/0022
9,420,872 B2 * 8/2016 Bird ..... A45F 5/02
2004/0108350 A1 6/2004 Warren
2007/0199767 A1 8/2007 Altieri
2013/0191970 A1 * 8/2013 Foreman ..... A41F 9/002 2/300
2018/0271261 A1 * 9/2018 Hoge ..... A45F 3/04
2019/0328121 A1 * 10/2019 Lundstedt, Jr. ..... A45F 5/021
2020/0107630 A1 * 4/2020 Rich ..... A45F 3/02

* cited by examiner

CARRYING DEVICES

CROSS-REFERENCE TO RELATED APPLICATION

This application is a national phase filing under 35 USC 371 of International Application No. PCT/US2018/059390, filed Nov. 6, 2018, claiming priority to U.S. Provisional Patent Application No. 62/582,168, filed Nov. 6, 2017, the contents and disclosures of which are incorporated by reference herein in their entirety.

FIELD

The present disclosure relates generally to the field of carrying devices, and in particular to backpacks including waist belts.

BACKGROUND

Carrying devices provide a convenient means for transporting items in a wide variety of fields, including but not limited to hunting, fishing, camping, expedition, and other outdoor activities. In general, these carrying devices are worn on the body of a user, and are typically backpacks. Each of these fields have developed various features and designs to accommodate users and user demands.

For sporting activities, such as hunting and fishing, the user may carry equipment in their hand while wearing a backpack. Although sheaths have been designed for stowing the equipment while not in use, as shown in U.S. Pat. Nos. 5,664,721; 6,763,987; and 9,194,655, these sheaths require the user to place the equipment away from the hands. This prevents the user from readily using the equipment and delays access to the equipment. When hunting, accessing stowed gun or bow may cause unwanted noise and delay.

U.S. Pat. No. 6,152,338 describes a modular load bearing field support system having a waist belt, a pair of shoulder straps, each of the shoulder straps having a front end attached to the waist belt and a rear end attached to the waist belt, and a middle section disposed between said front and rear ends. A mounting track is attached to said waist belt, and a spatula accessory support system is included for mounting an accessory on the mounting track. The spatula system includes a flat spatula attached to an accessory, with the spatula inserted between the mounting track and the waist belt to attach the accessory to the waist belt.

Carrying devices are also useful for transporting large loads. One problem associated with carrying a larger load is distributing the weight of the larger load in a comfortable manner for the user. Balancing the load during movement also becomes a problem as the load increases. To handle a larger load, a frame may be used, but conventional frames still suffer from problems of evenly distributing and balancing the load.

U.S. Pat. No. 6,179,188 discloses an external frame backpack including a frame, a hipbelt, two flexible stays, back panel, and a lower panel. The frame is external and substantially rigid, and includes upper, middle, and lower frame members secured between frame side rails. The hipbelt is attached to the frame adjacent to the lower frame member. The flexible stays are elongate with upper and lower ends. The upper ends are attached to the upper frame member. The lower ends are attached to the sides of the hipbelt. The stays are flexible to allow movement of the hipbelt as the stays bend while transmitting at least a portion of the weight held on the frame to the lower end of the stays.

The back panel is vertically and horizontally tensioned and secured to the frame. The lower panel is secured between the side rails of the frame. The lower panel includes a support sheet to maintain the shape thereof when tensioned between the side rails.

U.S. Pat. No. 6,607,108 discloses a backpack load transfer and stabilization system including a roll control rod coupled to a hip belt for a backpack. The control rod is contained entirely within the hip belt and extends across the width of the hip belt. The control rod is coupled, in turn, to semi-rigid extension members which serve as the interface between the hip belt and the main backpack. The extension members transfer the load to locations on the hip belt corresponding to hip locations of the person wearing the backpack. The extension members are rotatably coupled to the main backpack and rigidly coupled to the roll control rod, such that when a person wearing the backpack hikes, and the person's hips move up and down, the combination of the roll control rod and interconnected extension sections compensate for the up-and-down movement of the hips to stabilize the load and prevent side-to-side swaying.

Carrying oversized items is also challenging because the items carried may change as the user moves through the field. It is not practical to carry multiple backpacks. Further fastening items to the easiest accessible location, on the outside of the pack bag, does not position the weight efficient in the backpack and leads to more strain on the user.

U.S. Pat. No. 8,348,114 discloses backpack system is provided including an external frame, a pack bag and a sling configured for extending between the frame and pack bag providing a space between the frame and pack bag for accommodating heavy or bulky cargo therebetween. The sling can be extended or retracted in order to selectively adjust the distance between the pack bag and frame. The backpack system may also include a pouch for supporting a lower end of relatively long object therein, which may be carried in the space between the pack bag and frame.

U.S. Pat. No. 6,637,633 discloses backpack is provided with a mechanism whereby it can be used in a compact form for carriage of smaller loads or in an expanded form to carry larger loads. In its initial compact form, the backpack's cargo space is divided into two separate compartments which are fixedly attached along their outer vertical seams to the outer edges of the backpack's main panel, and are releasably attached to each other along a central vertical seam by means of a zipper or similar such fastening system. When this said fastening system is released, the primary storage compartments hinge and rotate outwardly, exposing a space that is made available for additional storage. A collapsible supplemental storage compartment is sewn or otherwise attached into this space in such a way that it can be opened and expanded when the afore-mentioned primary storage containers are outwardly deployed.

Thus, there remains a need for improved carrying devices. The properties and advantages of the present disclosure will become apparent to those of skill in the art upon reading the following disclosure.

SUMMARY

Covered embodiments are defined by the claims, not this summary. This summary is a high-level overview of various aspects and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

In some embodiments, a belt includes a waist belt and a retractable loop that is accessible from the waist belt and movable between a retracted position and an extended position.

In some embodiments, when extended the retractable loop is configured to support a load external to the waist belt. In some embodiments, the retractable loop has a first end, a second end opposite the first end, and a middle portion between the first and second ends, and when the retractable loop is in its extended position, both the first end and the second end ends of the retractable loop remain within the waist belt and the middle portion extends from the waist belt. In some embodiments, the belt also includes a clip joining the first end of the retractable loop to the second end of the retractable loop.

In some embodiments, the belt also includes a cord within an internal compartment, and the cord is configured to pull the retractable loop toward the retracted position when a wearer pulls the cord. In some embodiments, the cord has a first end and a second end, a first end of the cord is tied to the retractable loop, and the second end of the cord is attached within the internal compartment.

In some embodiments, the belt also includes a pull member connected to the retractable loop, the pull member is configured to remain external to the waist belt when the retractable loop is in the retracted position, and the pull member is configured to pull the retractable loop toward the extended position when a wearer pulls the pull member. In some embodiments, the retractable loop is made of a non-compressible material.

In some embodiments, a backpack includes a belt as described above and a carrier assembly, and the waist belt is connected to a lower end of the carrier assembly.

In some embodiments, a backpack includes at least one shoulder harness; at least one lower shoulder strap, each of the at least one lower shoulder strap being connected to a corresponding one of the at least one shoulder harness; a waist belt; a frame assembly comprising a lower member attached at one end to the waist belt and at least one outer lateral member having a hole; at least one pouch having an opening, wherein the at least one pouch is connected to a corresponding one of the at least one shoulder strap; at least one adjustable load strap, each of the adjustable load strap being connected to a corresponding one of the at least one pouch; and at least one rod, each of the at least one rod corresponding to one of the at least one outer lateral member, each of the at least one rod having a first end and a second end, the first end of the at least one rod being positioned within the hole of the corresponding one of the at least one outer lateral member, the second end of each of the at least one rod being positioned within the opening of a corresponding one of the at least one pouch, and each of the at least one pouch is configured to move freely with respect to the waist belt.

In some embodiments, the frame assembly includes at least one of aluminum, steel, titanium, or a composite structure of carbon fiber. In some embodiments, the frame assembly includes at least two intermediate members attached to the lower member, and at least one cross bar connects the at least two intermediate members to one another. In some embodiments, the at least one shoulder harness is connected to a shoulder system that is mounted to the intermediate members.

In some embodiments, the frame assembly comprises two outer lateral members that are connected by an upper member. In some embodiments, the frame assembly has a unitary construction. In some embodiments, the frame assembly includes at least one ring on each of the at least one outer lateral member. In some embodiments, each of the at least one rod includes fiberglass.

In some embodiments, each of the at least one rod is more flexible than the frame assembly. In some embodiments, the first end of each of the at least one rod is fixed within the hole of the corresponding one of the at least one outer lateral member. In some embodiments, each of the at least one adjustable load strap is adjustable so as to resiliently flex the corresponding one of the at least one road, thereby adjusting weight distribution of a load. In some embodiments, the second end of each of the at least one rod is releasable from the opening of the corresponding one of the at least one pouch.

In some embodiments, a backpack includes a frame assembly and a compartment assembly mounted to the frame assembly, the compartment assembly including at least one storage volume an expandable volume disposed adjacent to the frame assembly and comprising an internal support shelf having adjustable straps configured to connect the internal support shelf to the frame assembly.

In some embodiments, the expandable volume is disposed between the at least one storage volume and the frame assembly. In some embodiments, the expandable volume is divided from the at least one storage volume by a fabric wall. In some embodiments, the backpack also includes In some embodiments, the backpack also includes at least one removable volume. In some embodiments, the at least one removable volume is configured to be positioned above the expandable volume when the at least one removable volume is attached to the compartment assembly.

In some embodiments, the frame assembly also includes one or more rings. In some embodiments, the backpack also includes compression straps mounted to the one or more rings, and the compression straps are configured to compress the compartment assembly against the frame assembly.

In some embodiments, the frame assembly also includes an upper crossbar, and at least one of the adjustable straps is connected to the support shelf is mounted to the upper crossbar. In some embodiments, the frame assembly also includes a lower crossbar, and at least one of the adjustable straps connected to the support shelf is mounted to the lower crossbar.

In some embodiments, a backpack also includes at least one shoulder harness; at least one lower shoulder strap, each of the at least one lower shoulder strap being connected to a corresponding one of the at least one shoulder harness; a waist belt, wherein the frame assembly further comprises a lower member attached at one end to the waist belt and at least one outer lateral member having a hole; at least one pouch having an opening, wherein the at least one pouch is connected to a corresponding one of the at least one shoulder strap; at least one adjustable load strap, each of the adjustable load strap being connected to a corresponding one of the at least one pouch; and at least one rod, each of the at least one rod corresponding to one of the at least one outer lateral member, each of the at least one rod having a first end and a second end, the first end of the at least one rod being positioned within the hole of the corresponding one of the at least one outer lateral member, the second end of each of the at least one rod being positioned within the opening of a corresponding one of the at least one pouch, and each of the at least one pouch is configured to move freely with respect to the waist belt.

In some embodiments, the compartment assembly comprises a sleeve for the at least one rod, and each of the at least one pouch is separable from the compartment assembly.

BRIEF DESCRIPTION OF THE DRAWINGS

The accompanying drawings are included to provide a further understanding of the disclosure and are incorporated in and constitute a part of this specification to illustrate embodiments. Together with the description the drawings serve to explain the principles of the disclosure. The accompanying drawing figures referred to herein are not necessarily drawn to scale, but may be exaggerated to illustrate various aspects of the present disclosure, and in that regard, the drawing figures should not be construed as limiting.

DETAILED DESCRIPTION

Figure 1:
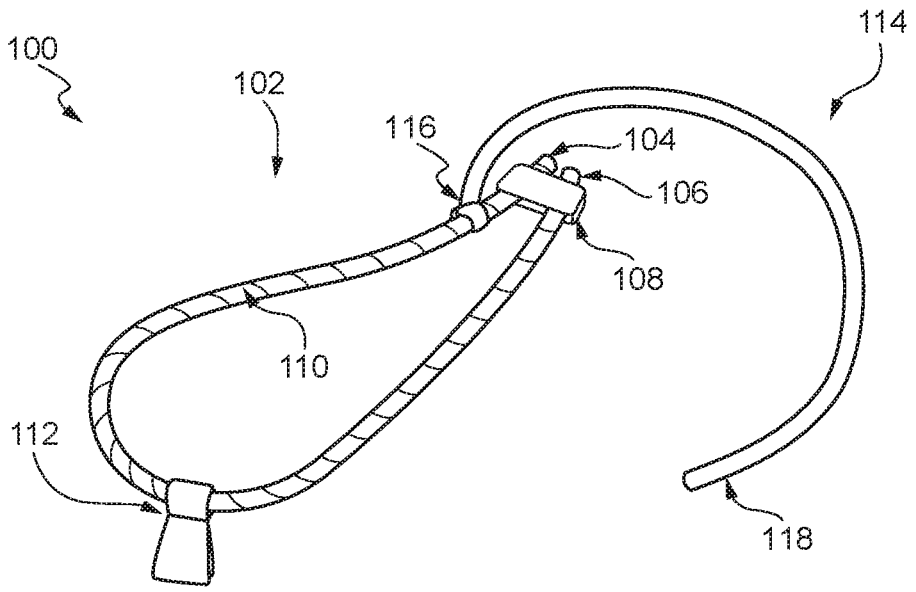
FIG. 1 shows a support system in accordance with embodiments disclosed herein.

The present disclosure provides various embodiments that may be used independently for different carrying devices and in some embodiments may be implemented within the same carrying device. When implemented together it is understood that the retractable support system operates independent of frame assembly and/or the expandable volume. Other embodiment may be employed to cooperate with each such as the frame assembly and the expandable volume.

Retractable Support System

Disclosed herein are carrying devices that allow a user to support a piece of equipment carried by hand. The carrying devices employ a retractable support system. The support system may be deployed as needed and stowed when not in use. For hunting purposes, a user may carry a firearm, e.g., gun or bow, for long distances and/or during periods of traversing rugged terrain. The user needs quick and ready access to the firearm in these situations. In this response, having a retractable support system allows the user to brace the firearm and frees up the hands to perform other tasks such as climbing, clearing obstacles or positioning equipment. The burden of carrying the equipment may also be alleviated by allowing the user to support the weight of the equipment reducing stress and fatigue of the arms.

There are several advantages of the support system described herein. One advantage is the support system is retractable allowing the user to stow the support system when not in use to prevent snagging or creating an obstruction. While hunting, when the user is moving through the brush, non-retractable support systems, such as a holster or a scabbard, would be exposed to snagging brush. A non-retractable support system would also create an obstruction when using the equipment.

The present support system is accessible in the front of the user to allow the user to grasp the equipment while being supported. The support system also provides an advantage of being deployable with one hand. Additionally, depending on the retracting mechanism, the support system may be retracted with one hand. Using only one hand is a significant advantage for deploying and retracting the support system.

The support system may be constructed from a non-compressible material such as a metal wire, monofilament of synthetic fibers, and other similar materials. In one embodiment, the metal wire may be coated with a plastic sheathing, which provides a smooth surface for supporting the equipment. The material has a sufficient coefficient of friction to prevent being deployed in an unintended manner. Non-compressible materials provide the rigidity necessary for deploying the support system with one hand. In addition, the rigidity is useful for supporting the piece of equipment carried by hand. The materials for the support system also have sufficient tensile strength to prevent tears or ruptures of the support system when being deployed or when holding equipment. In contrast a compressible material, such as a fabric cord, is difficult to deploy with one hand and lack the rigidity necessary to support the piece of equipment.

In one embodiment, the support system may be a closed-shaped loop. The loop may be a metal wire having a plastic coating where the ends of the loop are joined together. The loop is housed within an internal section of the carrying device. In other embodiments, the support systems may be a scabbard, sheathing, cradle or webbing. Each of these support systems may be retractable to allow the user to temporarily support a piece of equipment, such as an elongated object. Several types of elongated objects are often needed for ready use and are thus carried by hand. For purposes of the present disclosure, elongated objects may refer to firearms, such as guns and bows, but the support systems described herein may be used to hold other types of elongated objects as well.

For purposes of illustration a support system 100 is shown outside of a carrying device in FIG. 1. A non-compressible wire 102 is joined together at the ends 104, 106 by a fastener 108, such as a clip or grip. The ends 104, 106 may be welded or adhered to the fastener 108 to form the shape of the support system 100. In other embodiments, the fastener 108 may be releasable or adjustable. The wire 102 may have a diameter of 0.05 to 1 cm, e.g., from 0.1 to 0.8 cm. The wire 102 may be a catenary wire having a steel wire cote that is plastic coated. When the ends of the wire 102 are joined, the wire 102 forms a closed-shaped loop 110. The closed-shaped loop 110 is generally flexible, but not stretchable. Along the loop 110 is a pull member 112 that is accessible or otherwise exposed when support system 100 is retracted in the carrying device. Pull member 112 can glide along loop 110 and is made of a durable material.

As shown in FIG. 1, there is also a retractable cord 114 that is connected to the loop 110 at a first end 116 and may be affixed to the carrying device a second end 118. The retractable cord 114 may be a fabric cord or a nylon cord that is tied or secured to the loop 110. The second end 118 of the retractable cord 114 may be stitched or sewn into the carrying device. The cord 114 may be used to retract the loop 110.

In other embodiments, loop 110 may be retracted using an elastic wire or spring.

Figure 2A:
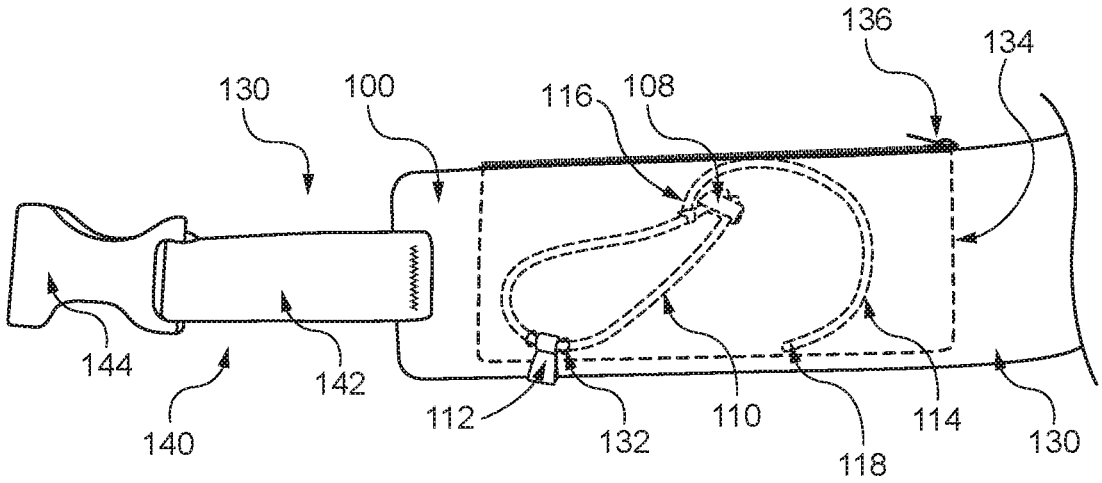
FIG. 2A shows a waist belt having a retracted support system in accordance with embodiments disclosed herein.
Figure 2B:
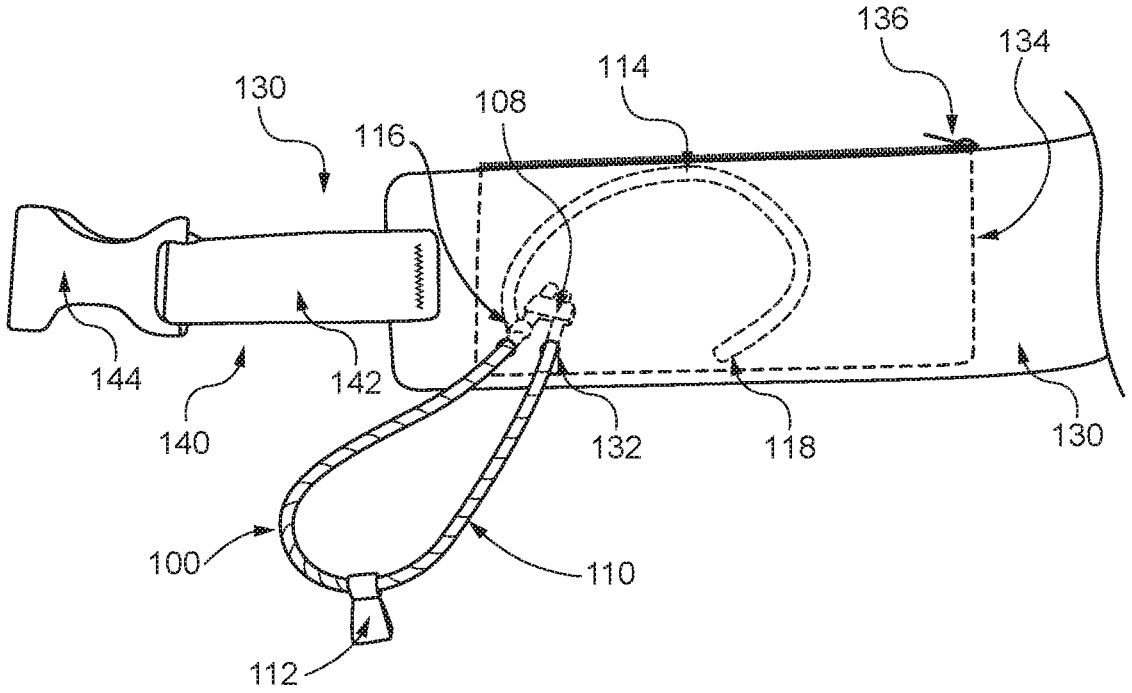
FIG. 2B shows a waist belt having a deployed support system in accordance with embodiments disclosed herein.

FIGS. 2A and 2B illustrate a support system 100 used within a waist belt 130. FIG. 2A illustrates the retracted mode of the support system 100 and FIG. 2B illustrates the deployed mode of the support system 100. There are holes 132 on waist belt 130 through which the loop 110 passes through. In some embodiments, a grommet may be inserted into holes 132 to provide further protection to the loop 110. In the retracted mode, loop 110 is held within the internal section 134. The internal section 134 may be a separate pouch on the waist belt 130. By pulling on the pull member 112, the loop 110 is extend out of the internal section 134 and is deployed. The fastener 108 may act as a stopper preventing the loop 110 from completely being pulled out of the internal section 134. This configuration allows a user to use one hand to deploy the loop 110. One end of the equipment, e.g. gun or bow, may rest within the loop 110. Depending on the length of wire 102 and position of fastener 108 the loop 110 may hang down a sufficient length to support an elongated object. For example, a firearm butt-stock or bow cam may rest within the loop 110. Unlike a holster, which is typically not retractable, the loop 110 does not secure or lock the firearm. In addition, loop 110 is not adjustable and cannot be opened. Loop 110 is made of a non-compressible material and is flexible to adjust to the shape and size of the equipment.

Retractable cord 114 may be within the waist belt 130 and is accessible through the closeable slot by opening zipper 136. Pulling the retractable cord 114 causes the loop 110 to return to the internal section 134. The pull member 112 may act as a stopper during the retraction. This configuration allows a user to use one hand to retract the loop 110.

There may be a wide variety of configurations of the waist belt 130 that has a support system 100 as described herein. In some embodiments, the waist belt 130 may have more than one of the support system 100. In some embodiments, a support system 100 is provided on each of the right and left sides of the waist belt 130 to accommodate the user. In some embodiments, to facilitate access, the support systems 100 are positioned in the front of the waist belt 130. Waist belt 130 has an elongated member 140 that is attached to straps 142, which may be adjustable, and are connected to one piece of a releasable fastener 144, such as a quick-release buckle. This provides additional stability for the carry device when worn by a user. The straps 142 may adjust the size of the waist belt 130 without interfering with the support system 100. The waist belt 130 fastens around the waist of a user, and can be adjusted to fit the waist of the particular user.

Figure 3:
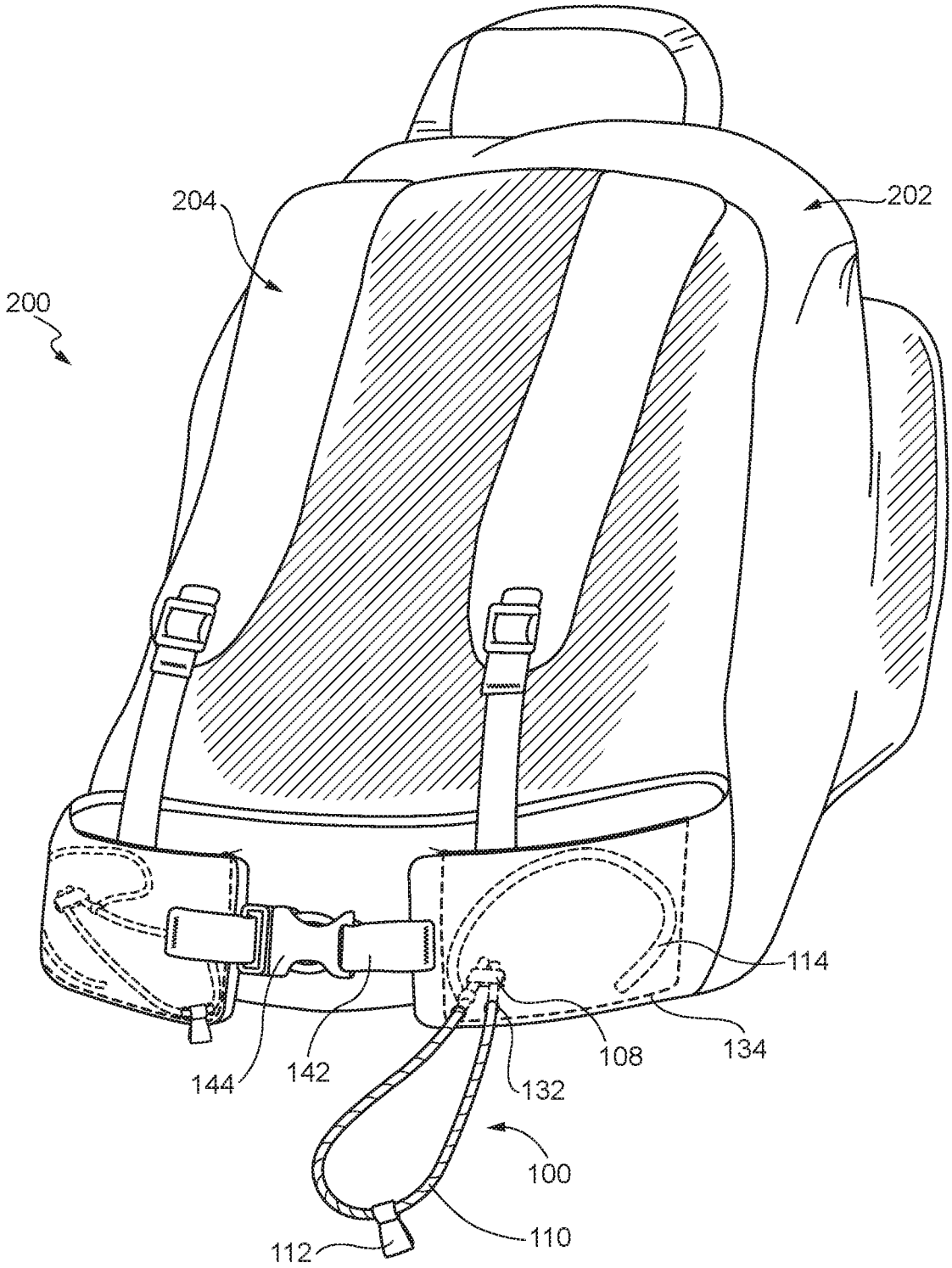
FIG. 3 shows a backpack with a support system in accordance with embodiments disclosed herein.
Figure 4:
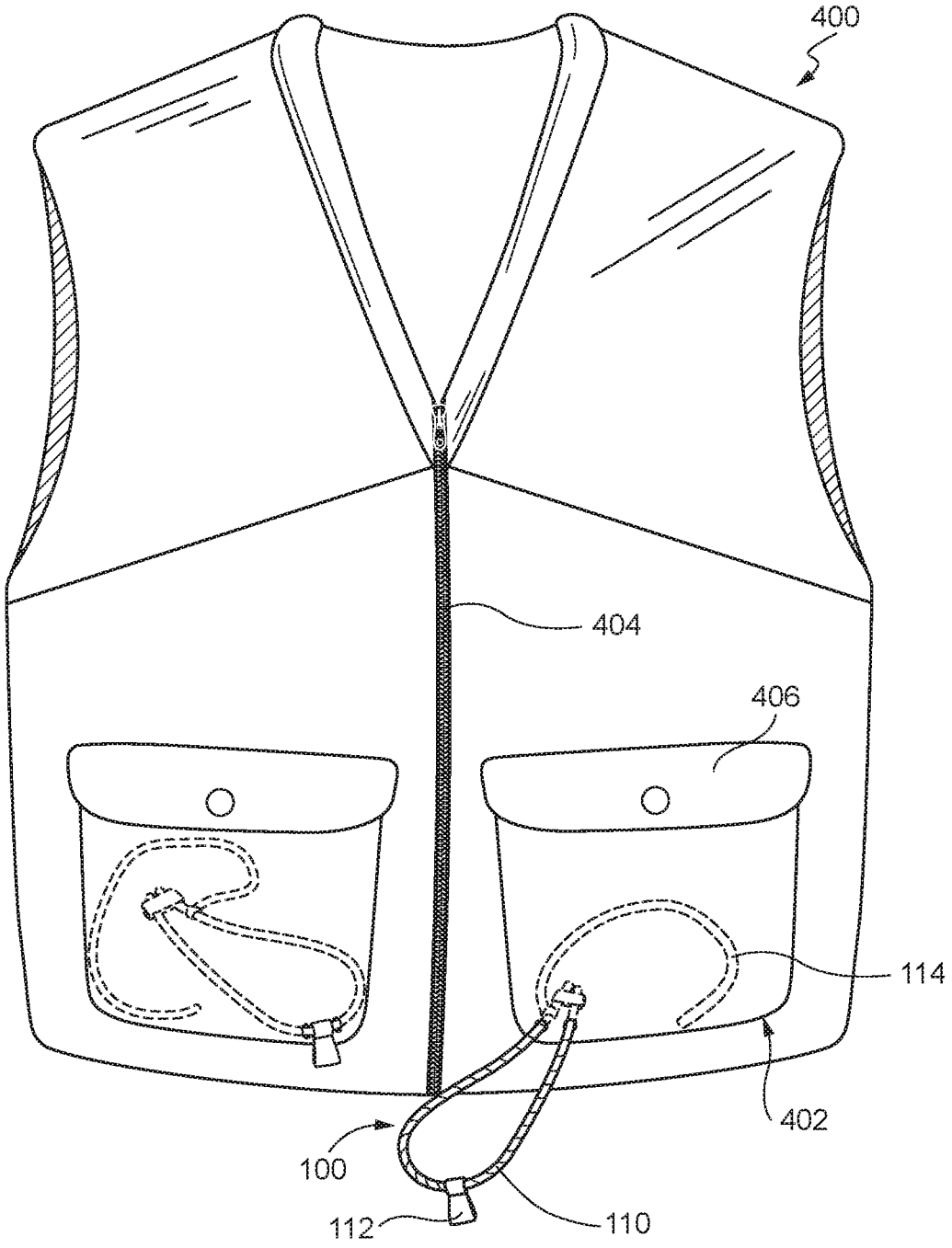
FIG. 4 shows a vest with a support system in accordance with embodiments disclosed herein.

Waist belt 130 having support system 100 may be used alone as a belt or may be incorporated with a carrying device, such as a backpack 200 (FIG. 3) or vest 300 (FIG. 4). The waist belt 130 may be integrally connected with a carrier assembly 202 of the backpack 200 or may be removably connected to the carrier assembly 202.

Carrier assembly 202 may comprise a frame and/or a plurality of compartments for stowing clothing, gear, food, cargo, etc. The dimensions of the carrier assembly can vary depending on design features. In some embodiments, carrier assembly 202 may have a hydration bladder for holding liquids. Regardless of the type of carrier assembly 202, the support system 100 may operate independent of the various features of the carrier assemblies and the retraction or deployment is not impeded by those features.

While the support system 100 is beneficial for providing ready access to the equipment, it may be desired to store the equipment for longer periods of time. In particular, firearms are typically of a sufficient length to be incompatible for storing within the carrier assembly. Thus, storing the equipment to provide protection against damage may be beneficial when not in use. In addition to the support system 100 that is temporarily deployable, the carrier assembly 202 may also have one or more clips, sheaths, slings, etc. for securing equipment, e.g., firearms, externally to the carrier assembly 202. These systems are independent of the support system 100 and are typically on the sides or rear of the backpack 200.

As shown in FIG. 3, in addition to the carrier assembly 202, backpacks also comprise shoulder harnesses 204 to support the carrier assembly 202 when worn by a user. Shoulder harnesses 204 are typically padded and are adjustable to provide the user comfort in wearing the backpack.

Although the carrying device having the support system is especially well suited to backpacks and waist belts, the support system may also be incorporated in clothing such as jackets, belts, waist packs, vests, bids, pants, etc.

FIG. 4 illustrates a vest 400 having a support system 100 as described herein. Vest 400 may have various pockets and pouches (not shown) for storing items. As shown in FIG. 4, pocket 402 stores a support system 100. Vest has a zipper 404 for joining around a user's body and openings for the head and arms. Support systems 100 may be provided for each hand of a user. The cord 114 is accessible by lifting flap 406 and retracting loop 110. The pull member 112 is accessible in the front of the user.

Frame System with Load Distribution

Another problem for hunters is transporting game from of the field. A hunter may travel by foot into the field for several miles before encountering game. Upon a successful hunt the hunter seeks to remove the game from the field by adding the weight to the backpack. This can significantly increase the load on the hunter, which can make it difficult and uncomfortable when transporting the added weight.

Rigid frames have been used to transmit the load to the waist belt, which allows the hunter to carry more weight with less stress. The problem is efficiently transferring the load to the hips and away from the small of the back. Without efficiently transferring the weight, the load is carried by the shoulders and the waist belt sags even with a frame. Disclosed herein are carrying devices that allows a user to support a load, and in particular a heavy load. In one embodiment the carrying device has a frame assembly that transfers the weight of the load to the waist. This advantageously reduces the load on the shoulders and lower back and provides comfort to the user which allows a user to carry larger loads. In some embodiments, up to 95% of the load may be transferred from the shoulders to the waist without compression. In addition, the frame reduces the stress caused by movement and reduces shifting of the load. This can provide more stability.

To provide these benefits the frame assembly has rods that are attached at one end to the frame members and the rods are held within a pouch opening on an opposite end. The rods are constructed of a non-compressible material, such as but not limited to fiberglass, carbon fiber, polyoxymethylene (e.g., as commercialized by E.I. du Pont de Nemours and Company of Wilmington, Del. under the trade name DELRIN™) and other similar materials. The rods are resilient and also have some flexibility and in particular are more flexible than the materials used to construct the frame assembly. The pouch is separate from the carrying device and can slide against the carrying device. In particular, the pouch slides against the waist or waist belt. This provides a highly positionable pouch that can be adjusted in multiple directions. To dynamically store energy, the pouches may be biased towards the hips, which biasing flexes the rod outward from the frame assembly. Straps or other types of fasteners may be used to bias the pouch toward the hips, which pulls the rods contained therein. As the user moves, the rods resiliently flex to release energy.

The pouch may be constructed of a material that is strong, smooth, and resistant to tearing. Suitable materials include nylon, vinyl, rubber, chlorosulfonated polyethylene synthetic rubber, and other reinforced textiles. The pouch opening may allow the rod to slide freely therewithin.

The frame assembly has outer later members having holes. The rods are fixed to the frame assembly by welding or an adhesive the rods in those holes. In one embodiment, the frame assembly may have a hole in an outer lateral member in which the rods are fitted and secured within. One rod on each side of the frame may be used to provide increase stability.

In one embodiment, the frame assembly, excluding the rods, may constructed of aluminum, steel, titanium, or a composite structure of carbon fiber, or other lightweight materials. The frame assembly may be internal, semi-internal or external and may have a unitary construction (e.g., may be formed as a single, monolithic part). A semi-internal frame is partially exposure and an internal frame is completely covered. The frame assembly may have a ring for securing gear, game, or other equipment to the frame. The frame assembly may be shaped to reflect the general curvature of a human back.

Figure 5:
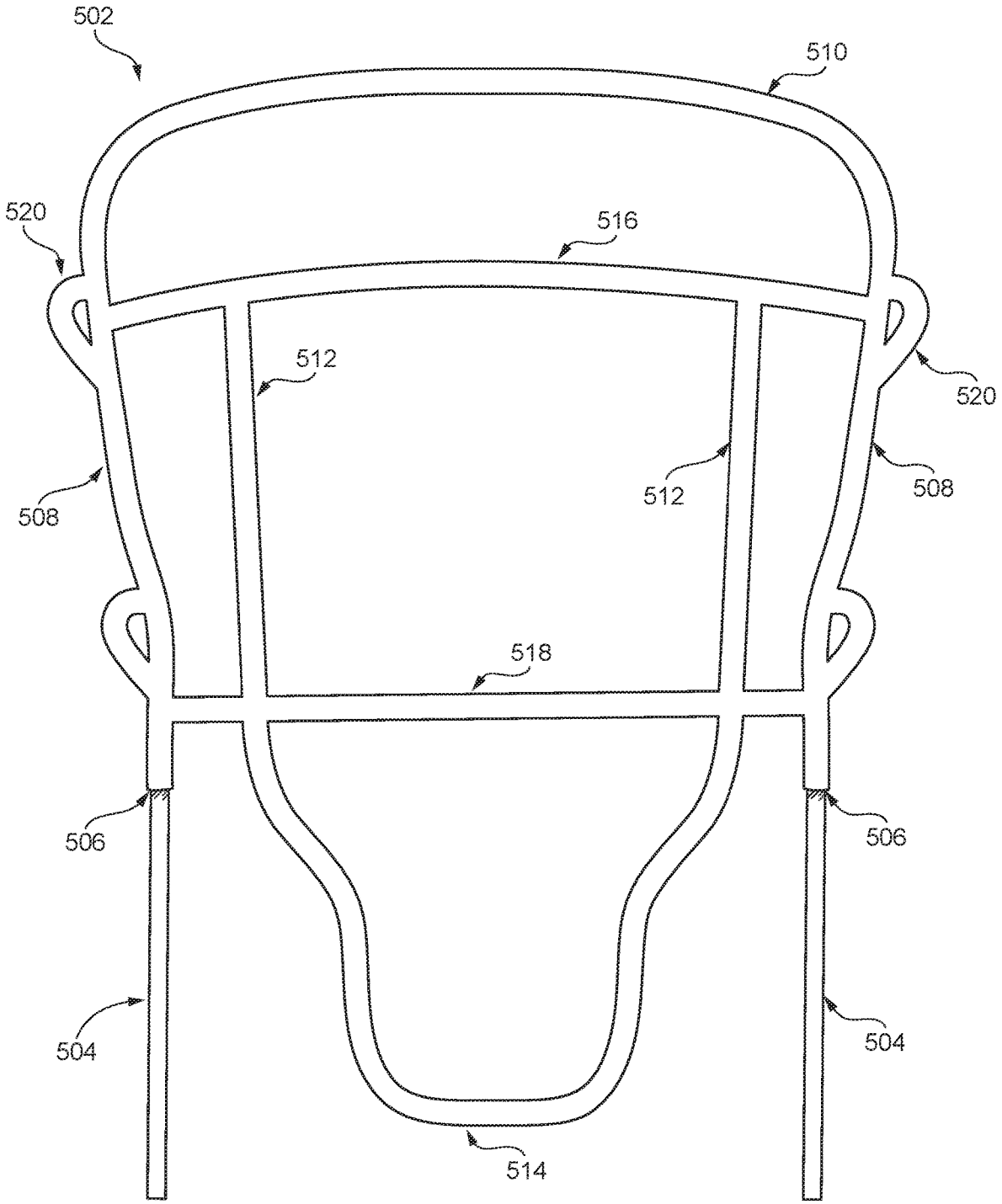
FIG. 5 shows a frame assembly in accordance with embodiment disclosed herein.

FIG. 5 illustrates a front view of frame assembly 502 having two rods 504 that are secured within holes 506 in the frame assembly 502. Rods 504 are constructed of a fiberglass material and are capable flexing. Rods 504 are secured in a manner as to not slide into or away from the frame assembly 502. Frame assembly 502 is a tubular construction having members that are welded together to provide rigidity. In other embodiments, where the elements of frame assembly 502 are fabricated of materials which cannot be welded, appropriate mechanical couplings may be used.

Although several members are shown in FIG. 5, it is understood that the frame assembly may have a unitary construction. Other configurations of frame assembly 502 may also be used in other embodiments. As shown in FIG. 5, frame assembly 502 comprises two outer lateral members 508 having holes 506 at one end and are adjoined together by an upper member 510. Upper member 510 may curve outward to provide space for a user's head or headgear. In one embodiment upper member 510 is positioned above the shoulders or the upper frame. Rods 504 are inserted into holes 506 and held in a fixed manner by welding or an adhesive, such as an epoxy. The diameter of rods 504 are less than the internal diameter of the outer lateral members 508. In one embodiment, the diameter of rods may be from 0.2 to 1 cm, e.g., from 0.3 to 0.8 cm or from 0.45 to 0.65 cm. The length of the rods 504 can vary for different carrying devices and in some embodiments, the length of the rods 504 is from 10 to 45 cm, e.g., from 20 to 35 cm. The rods 504 should have sufficient length to be flexible and extend at most about half way up the user's back and connect to the lower frame. The lower frame refers to the portion of the frame assembly that is below the shoulders. When the frame assembly 502 is worn by a user, the outer lateral members 508 are positioned vertically. In one embodiment the same piece of tubing may be integrally curved to form the U-shape configuration of the outer lateral members 508 and upper member 510. In an alternative embodiment, there may be an internal extension tube (not shown) that allows the upper member 510 to be extended or retracted relative to outer lateral members 508.

Two intermediate members 512 are positioned within the two outer lateral members 508. The intermediate members 512 are spaced apart to allow the shoulder harness (not shown) to be mounted thereto. In relation to the user, the intermediate members 512 are spaced apart to be on opposite sides of the user's vertebrae. Outer lateral members 508 extend outward and away from the intermediate members. These intermediate members 512, which also may be positioned vertically, are joined together by a lower member 514 and are fixed to an upper crossbar 516. Upper crossbar 516 may have an arcuate shape to follow the shape of a user's back. In one embodiment one piece of tubing may be curved to form the U-shape configuration of the intermediate members 512 and lower member 514. Lower member 514 may also have a curvature that follows the curve of a user's lower back. Upper crossbar 516 also joins each of the outer lateral members 508. In one embodiment upper crossbar 516 may be angled between the outer lateral members 508 and intermediate members 512. Above the holes 506 there is a lower crossbar 518 that joins to each of the outer lateral members 508 and intermediate members 512. Lower crossbar 518 provides rigidity to the frame assembly 502. In one embodiment, the lower crossbar 518 connects to the outer lateral members 508 above the holes 506 for receiving the rods 504. In one embodiment, lower crossbar 518 may be sectioned and welded between the outer lateral members 508 and intermediate members 512.

Although two crossbars are shown in FIG. 5, it should be understood that other frame constructions may have different configurations and a number of crossbars.

Further as shown in FIG. 5, along the perimeter of frame assembly 502 there are rings 520 that may be used to secure various items to frame assembly 502. Rings 520 are fixed to outer lateral members 508 and in one embodiment may be constructed of a similar material as outer lateral members 508. Rings 520 are position adjacent to the upper and lower crossbars 516, 518 that connect to the outer lateral members 508. The rings 520 are preferably rigid to provide a stable connection for securing or compressing items to the frame assembly 502, including the compartment assembly. In one embodiment, the compartment assembly is mounted to the frame assembly and compression straps connected to the rings compress the compartment assembly against the frame. This transfer the weight of the load to the frame. The number of rings may vary for each frame assembly from one on each side to several rings. In general, from one to up to ten rings on each side are sufficient for providing a user with the ability to secure items to the frame assembly. In some embodiments, hooks be mounted in a similar manner as rings.

Figure 6:
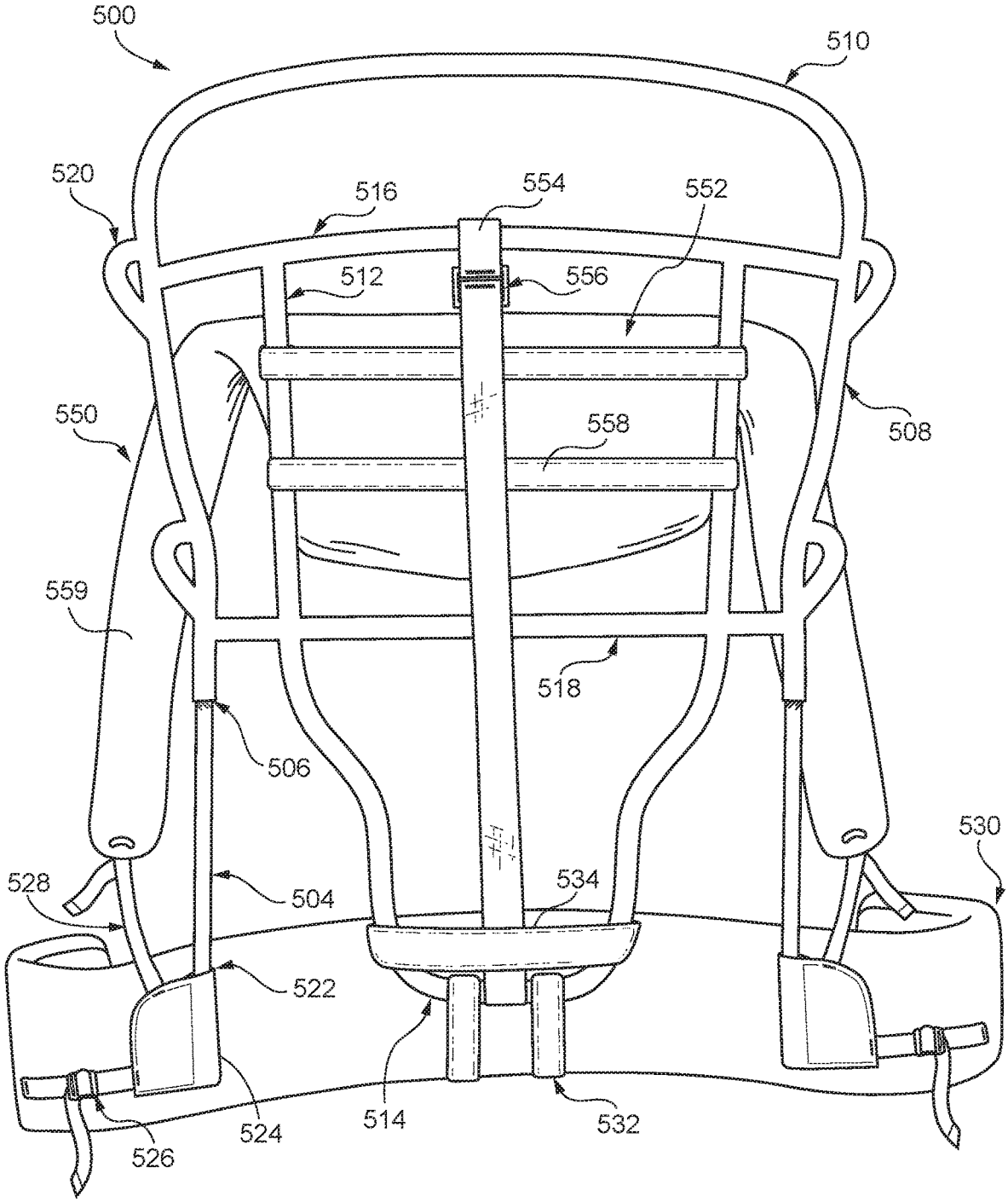
FIG. 6 shows a frame assembly having a shoulder system and waist system in accordance with embodiments disclosed herein.

When the frame assembly 502 is used in a carrying device, such as backpack 500, a waist belt 530 and a shoulder system 550 may be mounted to the frame assembly 502, as shown in FIG. 6. In one embodiment, the waist belt 530 is removably mounted to the frame assembly 502. Similarly, the shoulder system 550 may also be removably mounted to the frame assembly 502. By removably mounting the waist belt 530 and/or shoulder system 550, the frame assembly 502 may further provide comfort to the user.

To transfer the load from backpack 500, rods 504 are fixed to the outer lateral members 508 and at an opposing end are inserted into a pouch opening 522. Rods 504 may freely move within pouch opening 522 but are generally held in a tight or snug manner. In one embodiment, a length of at least 1 to 10 cm at the ends of rods 504 are held within the pouch opening 522 and can freely move therewithin. This allows rods 504 to be releasable from the pouch opening 522. Pouch opening 522 is part of a pouch 524 that can move along the waist belt 530 by sliding against or on the waist belt 530. Each pouch 524 is secured by an adjustable load strap 526 that is connected to the waist belt 530 and an adjustable shoulder strap 528 that is connected to the shoulder system 550. The straps may further comprise sliders and buckles. Adjustable load straps 526 move the rods 504 towards the hips and away from the lower member 514 of the frame assembly 502. This applies a tension on rods 504 and improves weight transfer. A user can adjust the weight distribution of the load by tightening or loosening adjustable load straps 526.

Due to the tension on the flexible rods 504 when adjustable load straps 526 are tightened, a user can move while rods 504 move with the user as they walk, hike, climb, etc. The rods 504 support the load during this movement. Thus, the frame assembly 502 comprises a rigid frame constructed from members and crossbars with a flexibility from the rods 504 that act to transfer a portion of the load to the sides of the user. This reduces the load on the back or on the shoulders of the user providing increased comfort to carry the load and thus reduce fatigue or stress.

FIG. 6 shows that lower member 514 of frame assembly may be held against waist belt 530 using straps 532. Straps 532 may have a hook-and-loop fastener attachment for adjusting the lower member 514. Lower member 514 is covered into a sleeve 534. Waist belt 530 has an adjustable fastener in the front (not shown) for fitting the waist belt 530 to the user. Waist belt 530 may also have webbing, pouches and pockets for storing items. Waist belt 530 may have a padded lumbar section for providing comfort to the user.

Shoulder system 550 comprises an upper region 552 that is attached to a tension strap 554 that wraps around the lower member 514 and upper crossbar 516. Tension strap 554 has a slider buckle 556 to move upper region 552 along the intermediate members 512 to fit the user. Various markings on the tension strap 554 may indicate predefined positions. Tension strap 554 further holders the shoulder system 550 in a taut configuration. Upper region 552 further comprises sleeve bands 558 that form a sleeve at each end to wrap around the intermediate members 512. Sleeve bands 558 may be mounted to upper region 552 may sewing, stitching or may be a releasable mechanism such as hook-and-loop fasteners. In other embodiments, sleeve bands may be adjustable to tighten the upper region 552 to the frame assembly 502. Tension strap 554 and sleeve bands 558 may be released to remove shoulder harness 559 from frame assembly 502. Shoulder harness 559 extends out from upper region 552 and is provided to attach the backpack 500 to the user. In one embodiment, upper region 552 and shoulder harness 559 are constructed of one piece of material to form a yoke. In other embodiments shoulder harness 559 may be sewn or attached as separate pieces to the upper region 552. Each shoulder harness 559 may be connected using an adjustment sternum strap (not shown) in the front of the user. Shoulder harness 559 as well as upper region 552 may be padded to provide comfort to the user.

As discussed above, the lower portion of shoulder harness 559 is connected by the adjustable shoulder strap 528 that is connected to the pouch 524. The adjustable shoulder strap 528 helps to bias the pouch 524 more forward and provide support for the pouch 524.

The frame assembly is simpler to manufacture and assemble. Further, the frame assembly is lighter in weight, but still provides improved load distribution for the user that is comfortable.

Backpack with Expandable Volume

Figure 7:
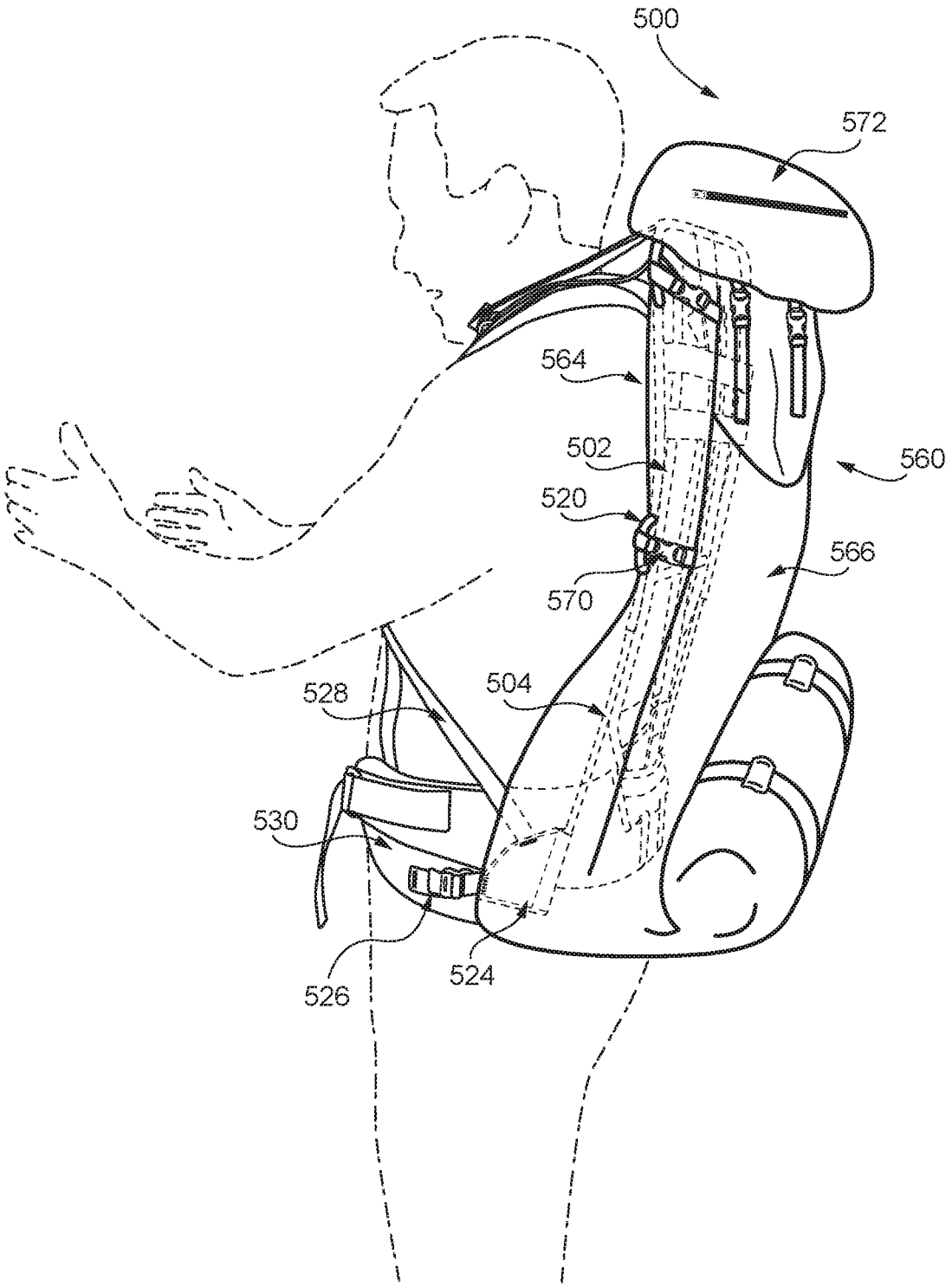
FIG. 7 shows a side view of the backpack with a semi-internal frame assembly worn by a user in accordance with embodiments disclosed herein.
Figure 8:
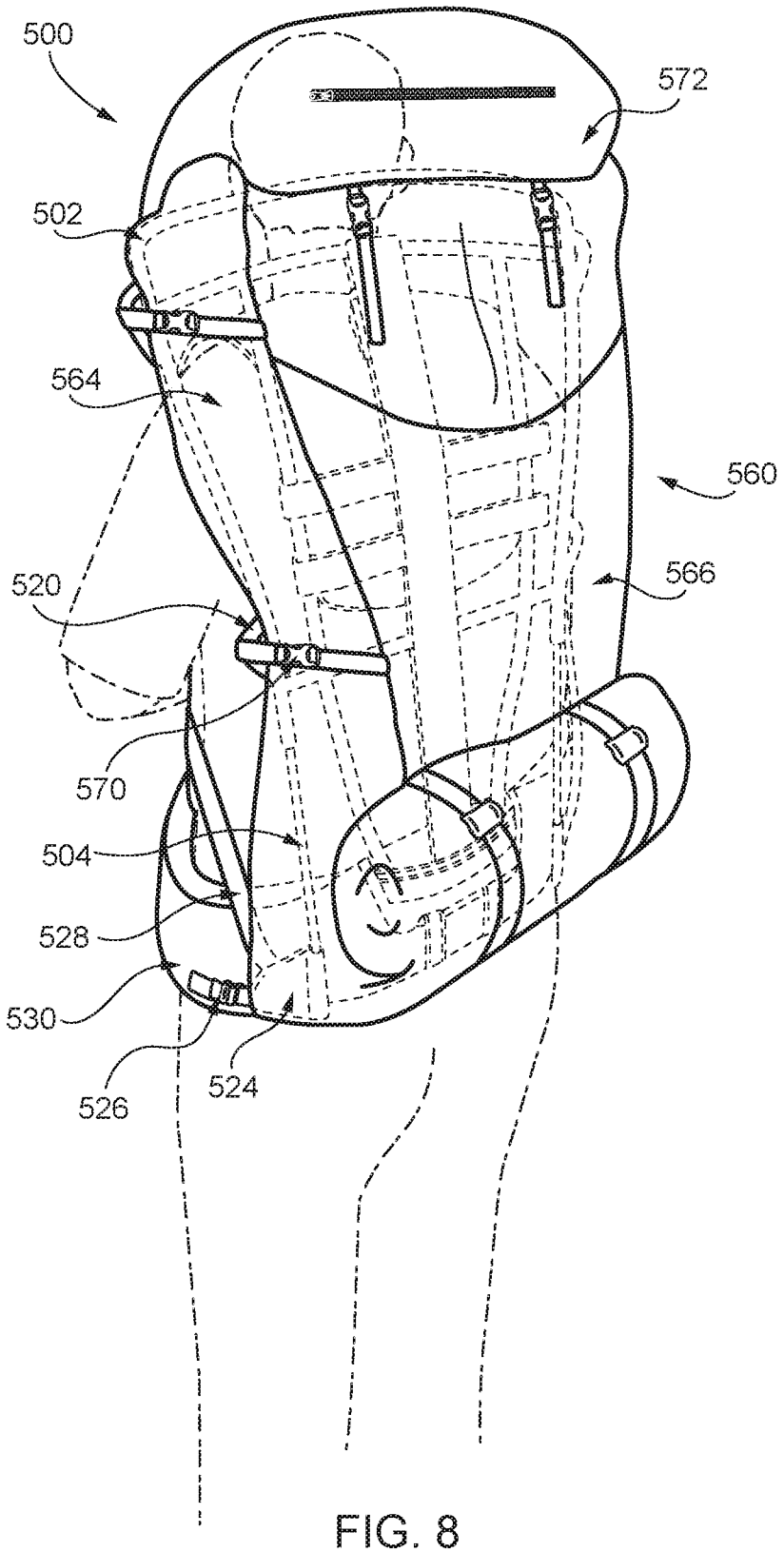
FIG. 8 shows a rear perspective view of a backpack showing the compartment assembly with a collapsed expandable volume in accordance with embodiments disclosed herein.

FIGS. 7 and 8 illustrate the frame assembly 502 worn by a user. As shown, adjustable load straps 526 bias the pouch 524 toward the hips of the user and increase tension on rods 504. This functions to transfer the load carried by frame assembly 502 forward and away from the user's back and shoulders. As the user moves or increases the weight of the load, the rods 504 can be adjusted through the adjustable load straps 526. The pouch 524 is positioned to rest against the waist belt 530. The pouch 524 does not extend above the waist belt 530 to prevent the pouch 524 from snagging or entangling with the gear or other items being carried inside the backpack 500.

In one embodiment, the frame assembly 502 may be positioned internally within a backpack 500 or a portion of the backpack 500 as shown in FIG. 7. In other embodiments, the frame assembly 502 may be semi-internal and a portion of the frame assembly 502 is covered by backpack 500. The compartment assembly 560 of the backpack 500 may be mounted to the frame assembly 502 to cover all or a majority of the frame assembly 502. The compartment assembly 560 may comprise various sections, pouches, pockets and attachments that are associated with various backpack designs. When used internally, the rods 504 may be covered in a webbing (not shown) to prevent snagging or entanglement. Even with an internal frame assembly, the rods 504 and pouch 524 can move to transfer the load to the hips of the user.

Using a frame assembly 502 that can carry heavier loads as described above, leads to another embodiment of the present disclosure that provides a compartment assembly 560 capable of accommodating load, such as game or a portion thereof.

In one embodiment, the compartment assembly 560 comprises an expandable volume 564 and a storage volume 566. Although one storage volume 566 is shown in FIGS. 7 and 8, there may be additional storage volumes as separate compartments, pouches, or pockets. For example, there may be an upper storage volume for holding gear, clothing and/or food and a lower storage volume for holding tents and sleeping bags. For purposes of convenience, one storage volume 566 will be described, but it should be understood that multiple storage volumes may be used with various backpacks covered by the embodiments disclosed herein.

The expandable volume 564 can hold heavier loads and is positioned adjacent to the frame assembly 502. The types of heavier loads are not restricted by the present disclosure and may include any heavy load that the user seeks to carry. This allows the weight of the heavier loads to be distributed to the hips of the users. Advantageously, the expandable volume 564 does not increase the width of the backpack 500, which would cause an undesirable shifting of the weight. In one embodiment the expandable volume 564 when fully expanded has a volume that is greater than storage volume 566. Thus, a user can carry large objects like portions of game, such as antlers of the game or larger portions of meat from the game. Additionally, when the expandable volume 564 is not in use, it may be compacted between the frame assembly 502 and the storage volume 566. The fabric of expandable volume 564 may be folded and tucked. In other embodiments, expandable volume 564 may be elastic to allow the expandable volume 564 to enlarge.

Storage volume 566 is positioned on a side of the expandable volume 564 that is opposite of the frame assembly 502 and is separated from the expandable volume 564 by a fabric wall to keep items separated. There may be one or more flaps, zippers, or openings for accessing storage volume 566. Compression straps 570 connect the compartment assembly 560 to the frame assembly 502 and are attached to the rings 520 on the frame assembly 502. Compressions straps 570 have one or more adjustment sliders that allow a user to tighten the load to the frame assembly 502. The free end of the straps 570 may be stored in a rolled position and held securely to avoid entanglement. Compressing the load carried in the compartment assembly 560 closer to the frame assembly 502 enables the backpack 500 to carry heavier loads.

Compartment assembly 560 extends over the pouch 524 and may have a sleeve or other webbing that covers or partially covers the rods 504. Although rods 504 are covered by compartment assembly 560, the pouch 524 with the inserted rod 504 can still slide along waist belt 530 to distribute the load carried by the backpack 500 to the hips of the user when adjustable load strap 526 is adjusted.

The backpack shown in FIG. 8 has an additional removable volume 572 that is connected above the expandable volume 564 and the storage volume 566. Removable volume 572 covers the compartment assembly 560. Removable volume 572 may be raised and lowered by adjusting the straps, which may have snap-fit buckles, as needed to accommodate the changing volume of the expandable volume 564.

Each of these volumes may comprise one or more pouches or pockets. In addition, each volume may be subdivided into separate compartments. In addition, the volumes are constructed of flexible materials such as a heavy duty, lightweight nylon or similar fabric. The volumes generally are enclosures having walls that surround the opening to the volume.

Figure 9:
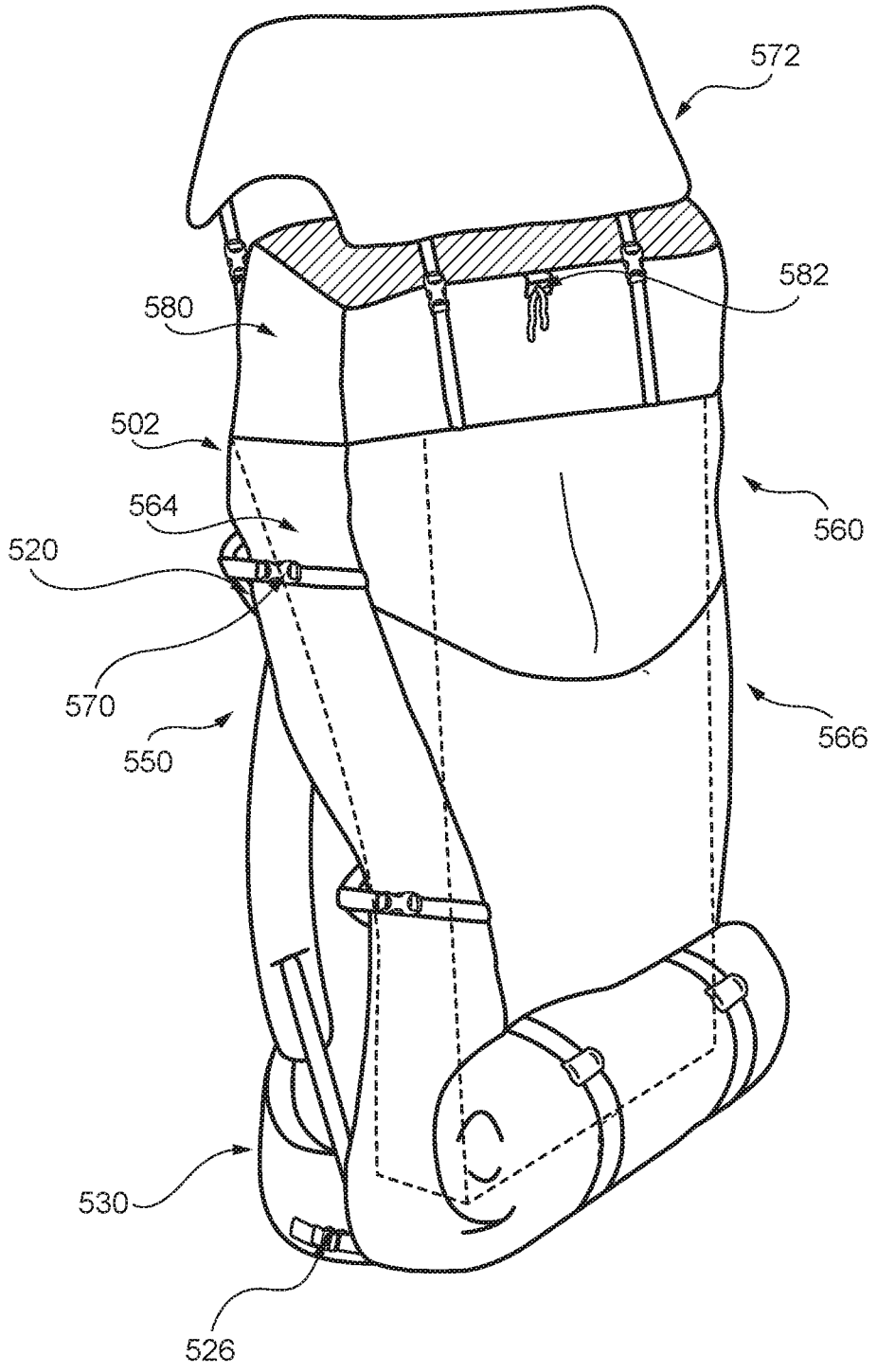
FIG. 9 shows an exploded perspective view of a backpack showing the compartment assembly with an enlarged expandable volume and removable volume in accordance with embodiments disclosed herein.

In one embodiment releasable hooks (not shown) are opened at the opening of the expandable volume 564 to enlarge the expandable volume 564, as shown in FIG. 9. The releasable hooks are on a strap and the length of the strap can be adjusted depending on the enlargement of the expandable volume 564. Additional fabric 580 may be pulled upward to increase the depth of the expandable volume 564. A draw string 582 may be provided on the opening to the expandable volume 564 to close or tighten the expandable volume 564, as needed. When antlers are transported, due to their irregular shape and size the antlers may extend through the opening once the draw string is tightened and the removable volume is placed over the top of the expandable volume 564.

Having an expandable volume 564 provides a user with versatility to carry heavy and bulky loads and take on additional weight while moving through the field. For example, when hunting the backpack 500 may be relatively compact because the expandable volume 564 is compressed. The user does not have the need to carry any heavy or bulky items. The user has sufficient space in the other storage volume 566 for transporting equipment used during the hunt, such as a tent, clothing, food, water, sleeping bag, and related gear. Once game is taken and dressed, the user can enlarge expandable volume 564 to transport the game, or a portion thereof, from the field. In one embodiment, enlarging the expandable volume 564 does not impact the space of the storage volume 566. In addition, by positioning the expandable volume 564 close to the frame assembly, the weight is more readily distributed from the frame assembly to the user hips. To further maintain weight in a position that is easy to transport, a storage shelf 574 is provided within the expandable volume 564. This also keeps the weight on the back of the user without having to reconfigure the backpack to move items in the storage volumes.

Figure 10:
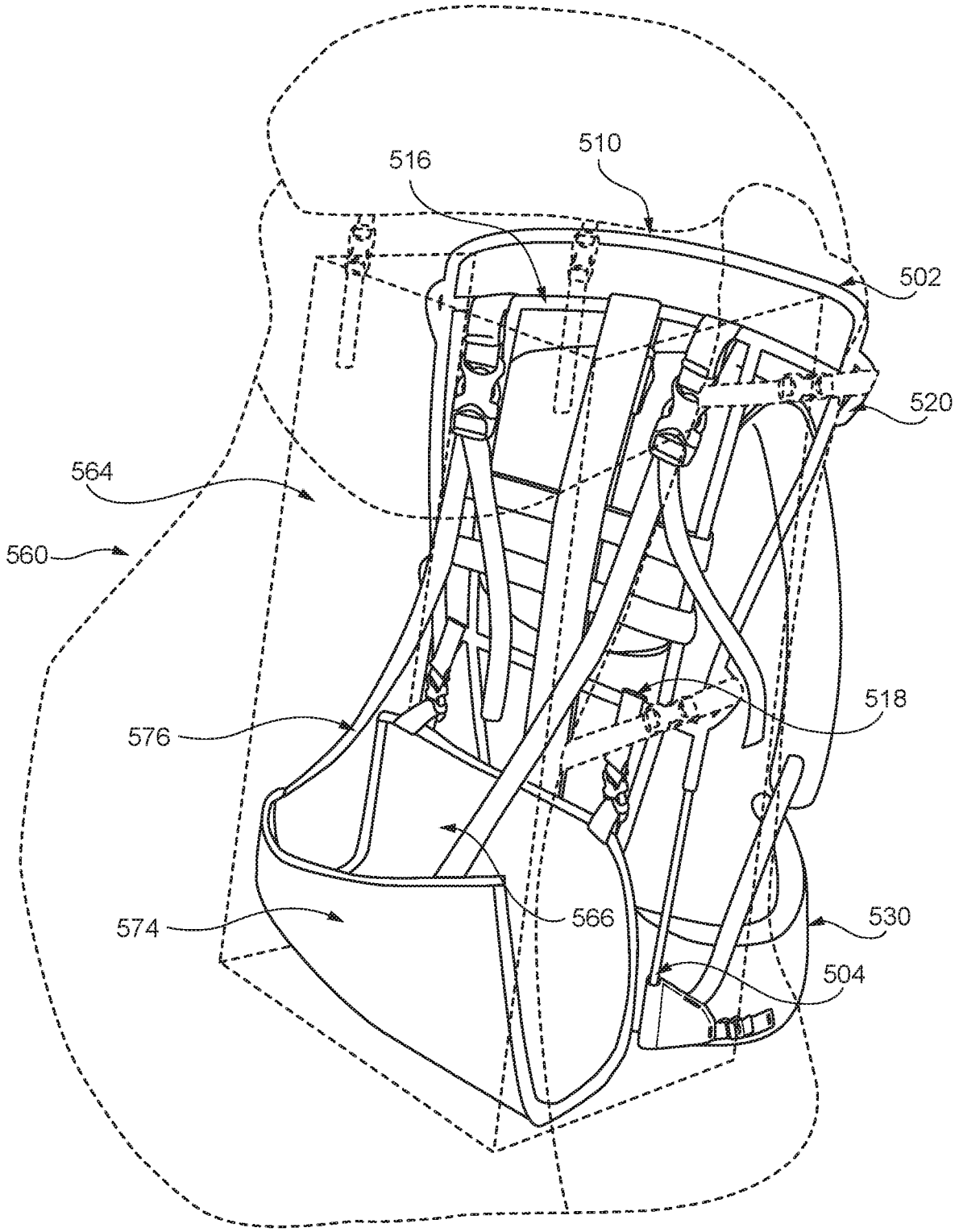
FIG. 10 shows a partially cut-away view of a support shelf attached to the frame assembly in accordance with embodiments disclosed herein.

FIG. 10 shows the storage shelf 574 inside the expandable volume 564. Other features have been removed for the clarity of the drawing. As shown in FIG. 10, the storage shelf 574 may have several lashing straps 576 that are connected to the frame assembly 502 and in particular to the upper crossbar 516 and lower crossbar 518. Storage shelf 574 keeps the heavy load positioned higher on the user where the load can be transferred by the rods 504 to the hips. The lashing straps 576 that connect to the upper crossbar 516 may be longer than the lashing straps 576 that connect to the lower crossbar 518. Storage shelf 574 is made of flexible fabric and lashing straps 576 may be provided on each of the corners. Lashing straps 576 have adjustable buckles and may be tightened as needed to support the weight of the items in the expandable volume 564. In addition, the storage shelf 574 compresses the weight of the items closely to the frame assembly 502. The storage shelf 574 may be stowed in the expandable volume 564 when collapsed.

For hunting applications, the expandable volume 564 is used for transporting game taken from the field. A double lined fabric wall may surround the expandable volume 564 to prevent leakage into the other storage volumes 566. In addition, the expandable volume 564 may have one or more drainage holes provided in the lower portion thereof.

For military applications, the expandable volume 564 is used for transporting heavy items, including communication equipment, weapons, shelters, as well as other oversized items. Such items can have a significant weight and it is desirable to transport these items without placing strain on the user.

The fabrics used for the carrying device used herein may have a suitable camouflage pattern for use in hunting and military applications. For example, the pattern may have a concealment pattern such as the concealment pattern commercialized by W.L. Gore and Associates of Newark, Del. under the trade name OPTIFADE™.

All of the straps used in the various embodiments discussed herein are constructed of a durable and fabric-like material, such as nylon or polyester strapping regularly used for carrying devices, such as backpacks. The straps may be affixed by sewing, stitching, adhering or welding the straps to their respective components or may be removably attached, for example, with hook and loop fasteners. Various buckles for adjustment and release of the straps described herein may be quick release buckles comprised of corresponding releasable buckle connectors or any other type of fasteners.

Carrying devices have been described above both generically and with regard to specific embodiments. It will be apparent to those skilled in the art that various modifications and variations can be made in the embodiments without departing from the scope of the disclosure. Thus, it is intended that the embodiments cover modifications and variations provided they come within the scope of the appended claims and their equivalents.

As used herein, the conjunction "and" is intended to be inclusive and the conjunction "or" is not intended to be exclusive unless otherwise indicated. For example, the phrase "or, alternatively" is intended to be exclusive. The use of the terms "a", "an", "the", or similar referents in the context of describing the invention (especially in the context of the claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted.

As used herein, the term "about" refers to a degree of deviation typical for a particular property, composition, amount, value or parameter as identified; such as deviations based on experimental errors, measurement errors, approximation errors, calculation errors, standard deviations from a mean value, routine minor adjustments, and so forth.

Recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as", "for example") provided herein, is intended merely to better illuminate the invention and does not pose a limitation on the scope of the invention unless otherwise claimed.

What is claimed is:

1. A backpack comprising:

at least one shoulder harness;

at least one lower shoulder strap, each of the at least one lower shoulder strap being connected to a corresponding one of the at least one shoulder harness;

a waist belt;

a frame assembly comprising a lower member attached at one end to the waist belt and at least one outer lateral member having a hole;

at least one pouch having an opening, wherein the at least one pouch is connected to a corresponding one of the at least one shoulder strap;

at least one adjustable load strap, each of the adjustable load strap being connected to a corresponding one of the at least one pouch; and at least one rod, each of the at least one rod corresponding to one of the at least one outer lateral member, each of the at least one rod having a first end and a second end, the first end of the at least one rod being positioned within the hole of the corresponding one of the at least one outer lateral member, the second end of each of the at least one rod being positioned within the opening of a corresponding one of the at least one pouch, wherein each of the at least one pouch is configured to move freely with respect to the waist belt.

2. The backpack of claim 1, wherein the frame assembly includes at least one of aluminum, steel, titanium, or a composite structure of carbon fiber.

3. The backpack of claim 1, wherein the frame assembly comprises at least two intermediate members attached to the lower member, wherein at least one cross bar connects the at least two intermediate members to one another.

4. The backpack of claim 3, wherein the at least one shoulder harness is connected to a shoulder system that is mounted to the intermediate members.

5. The backpack of claim 1, wherein the frame assembly has a unitary construction.

6. The backpack of claim 1, wherein the frame assembly comprises at least one ring on each of the at least one outer lateral member.

7. The backpack of claim 1, wherein the first end of each of the at least one rod is fixed within the hole of the corresponding one of the at least one outer lateral member.

8. The backpack of claim 1, further comprising:

a compartment assembly mounted to the frame assembly, the compartment assembly comprising:

at least one storage volume; and an expandable volume disposed adjacent to the frame assembly and comprising an internal support shelf having adjustable straps configured to connect the internal support shelf to the frame assembly.

9. The backpack of claim 8, wherein the expandable volume is disposed between the at least one storage volume and the frame assembly.

10. The backpack of claim 8, wherein the expandable volume is divided from the at least one storage volume by a fabric wall.

11. The backpack of claim 8, further comprising at least one removable volume.

* * * * *